US008973783B2

(12) United States Patent
Clouser

(10) Patent No.: US 8,973,783 B2
(45) Date of Patent: Mar. 10, 2015

(54) LABEL DISPENSER

(71) Applicant: Doug Clouser, Galloway, OH (US)

(72) Inventor: Doug Clouser, Galloway, OH (US)

(73) Assignee: Gary L. Sharpe, Naples, FL (US)

( * ) Notice: Subject to any disclaimer, the term of this patent is extended or adjusted under 35 U.S.C. 154(b) by 48 days.

(21) Appl. No.: 13/779,291

(22) Filed: Feb. 27, 2013

(65) Prior Publication Data

US 2014/0239009 A1 Aug. 28, 2014

(51) Int. Cl.
*B65C 11/00* (2006.01)

(52) U.S. Cl.
CPC ..... *B65C 11/00* (2013.01)
USPC ..... 221/286; 221/283; 221/282; 221/70; 242/588.3

(58) Field of Classification Search
USPC ..... 221/70, 71, 72, 73, 282, 283, 286; 242/588.3
See application file for complete search history.

(56) References Cited

U.S. PATENT DOCUMENTS

| | | | | | |
|---|---|---|---|---|---|
| 810,791 | A * | 1/1906 | McCourt et al. | 225/38 |
| 3,231,130 | A * | 1/1966 | Foote | 221/70 |
| 3,514,016 | A * | 5/1970 | Hackney | 221/70 |
| 3,537,933 | A * | 11/1970 | Severance | 156/719 |
| 3,547,327 | A * | 12/1970 | Mariani | 225/38 |
| 3,554,847 | A * | 1/1971 | Broemmlsiek | 156/767 |
| 3,698,600 | A * | 10/1972 | Foote | 221/70 |
| 4,162,739 | A | 7/1979 | Nelson | |
| 5,570,809 | A * | 11/1996 | Martin | 221/73 |
| 5,704,480 | A * | 1/1998 | Scholz et al. | 206/438 |
| 5,950,959 | A * | 9/1999 | Milliorn | 242/588.3 |
| 7,500,635 | B2 * | 3/2009 | Cooper, Jr. et al. | 242/588.6 |
| 8,251,212 | B2 * | 8/2012 | Dunlap | 206/403 |
| 2006/0175017 | A1 * | 8/2006 | Namekawa et al. | 156/443 |
| 2007/0210099 | A1 | 9/2007 | Van Waes | |
| 2011/0315707 | A1 * | 12/2011 | Kleinhuber | 221/155 |
| 2013/0153593 | A1 * | 6/2013 | Silagy | 221/1 |
| 2013/0228574 | A1 * | 9/2013 | Hill, Gary | 220/9.2 |

FOREIGN PATENT DOCUMENTS

| | | |
|---|---|---|
| WO | WO/00/24638 | 5/2000 |

* cited by examiner

*Primary Examiner* — Patrick Mackey

(74) *Attorney, Agent, or Firm* — Standley Law Group LLP

(57) ABSTRACT

A label dispenser having a body and a hinged lid attached thereto. The lid is held in a closed position by way of magnets. The interior of the body has guides that hold label packs in a vertical arrangement. The labels and liner are passed between the body of the dispenser and the lid.

20 Claims, 13 Drawing Sheets

LABEL DISPENSER

TECHNICAL FIELD

The present invention is related to an apparatus for holding and dispensing labels. More particularly, the present invention relates to an apparatus for holding and dispensing a label having a gap therein that automatically removes a label from its liner when a downward force is applied.

BACKGROUND OF THE ART

In hospital and clinical settings a wide variety of labels are used. The labels are used for easy identification and to prevent errors in medication or instrumentation. With the use of labels comes the ever increasing need for a storage solution and the ability to easily and quickly dispense the labels.

Traditional label dispensing and storage methods, while adequate for storage are rather difficult to operate. Traditional label dispensers typically route the label and its liner through a series of S-curves and bars in order to assist in the removal of the label from the liner. This routing of the liner and the label makes refilling the label dispenser difficult and time consuming.

In still other traditional label dispensers the label and the liner may be routed separately in order to assist in the removal of the label from the liner. In these types of label dispensers it is necessary to route the liner through a slotted body. Like the label dispensers that have curves and bars, it is time consuming to route the label and the liner separately and it is difficult to thread the liner through the slotted body.

In addition, another problem with traditional label dispensers is that they are unable to accommodate a variety of label sizes in a single device. This can lead to clutter and the need to acquire several different label dispensers.

Accordingly, being able to effectively store and easily dispense a variety of label sizes is an ongoing concern in the industry. Consequently, there is a need for a label dispenser that stores, dispenses, and is easily refilled that can accommodate a variety of label sizes.

SUMMARY OF THE INVENTION

Accordingly, exemplary embodiments of the present invention have been made to remedy the previous mentioned problems. One objective of the exemplary embodiment is to provide storage and a means of dispensing a variety of label sizes. In the exemplary embodiments, the label blister packaging is held vertically in the body of the dispenser by guides. A lid is provided to keep the label packs within the dispenser and to allow multiple dispensers to be stacked atop one another. The body of the dispenser has four walls and a bottom forming a box. Optional support legs may be added to the outside of the box to improve stability.

A flange is provided along the front wall of the body of the dispenser. This flange assists in keeping the lid of the dispenser in a closed position and assists with the dispensing of the labels. The flange has magnets positioned therein that align with magnets or ferromagnetic material in support members on the lid. As the lid is shut the magnets in the flange and the magnets or ferromagnetic material in the support members are brought in close proximity and the attractive force keeps the lid in the closed position.

Although the flange and the support members are in close proximity, there is a gap between the two elements. This gap allows the labels and liner to the pass therebetween. To dispense the labels, the labels and liner are passed between the flange and the support members. The liner is then pulled downward across the flange. This downward tension causes the liner to pull away from the label thus automatically removing the label from the liner.

The lid and bottom of the body of the dispenser may have features allowing multiple dispensers to be stacked atop one another. Likewise, the end walls of the dispensers may have connectors that allow multiple dispensers to be linked together. The dispenser body also has attachment points that allow the dispenser to be fixed to a surface such as a wall.

BRIEF DESCRIPTION OF THE DRAWINGS

The advantages and other characteristics of the disclosed embodiments will be better understood when attention is directed to the accompanying drawings, wherein identical elements are indentified with identical reference numerals and wherein.

DETAILED DESCRIPTION OF THE EXEMPLARY EMBODIMENTS

Exemplary embodiments of the present invention will now be described in greater detail. It should be recognized that the present invention can be practiced in a wide range of other embodiments besides those explicitly described, and the scope of the exemplary embodiments described are expressly not limited.

Figure 1:
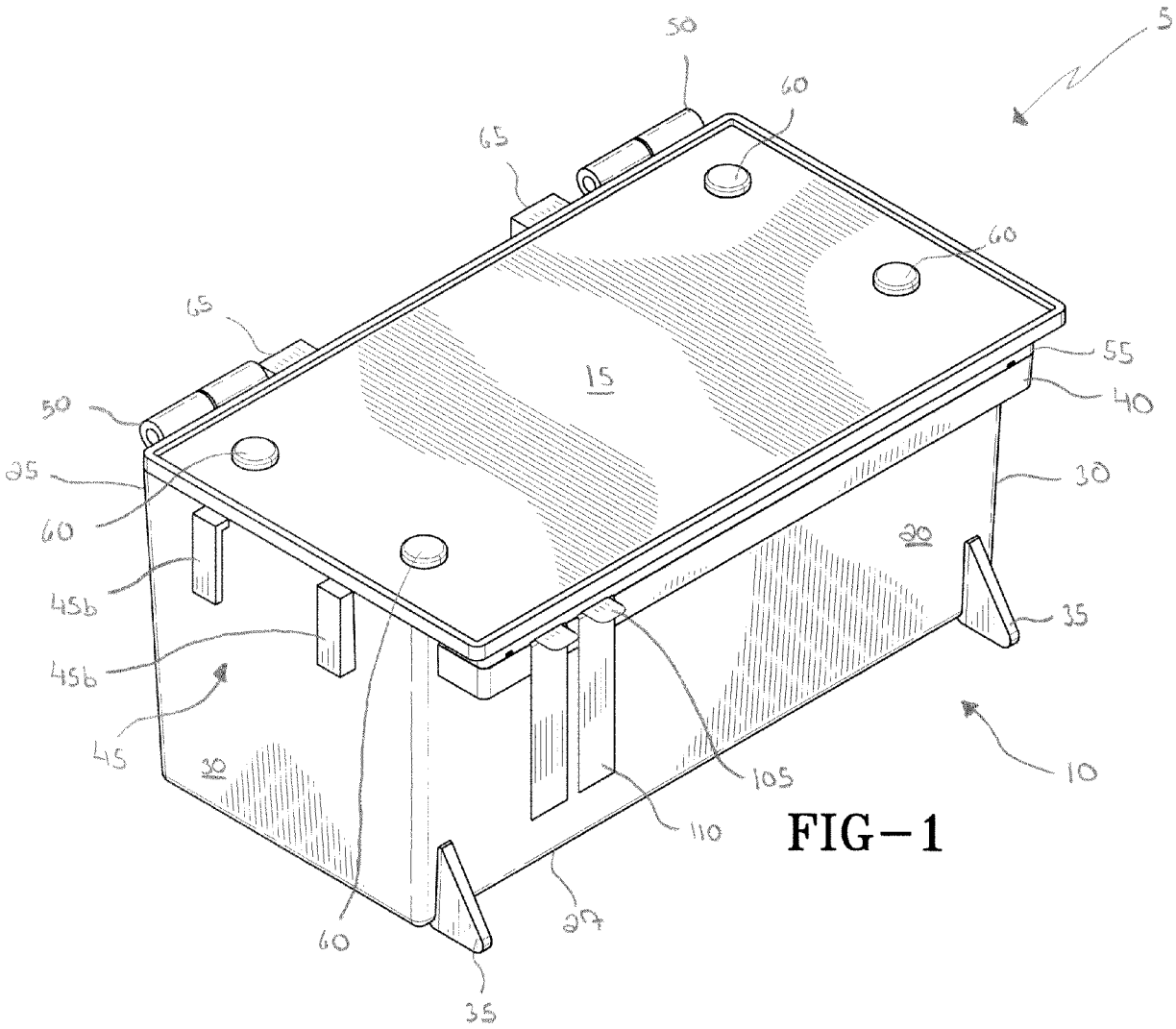
FIG. 1 is a top perspective view of an exemplary embodiment of a label dispenser having its lid closed and having optional feet.
Figure 6:
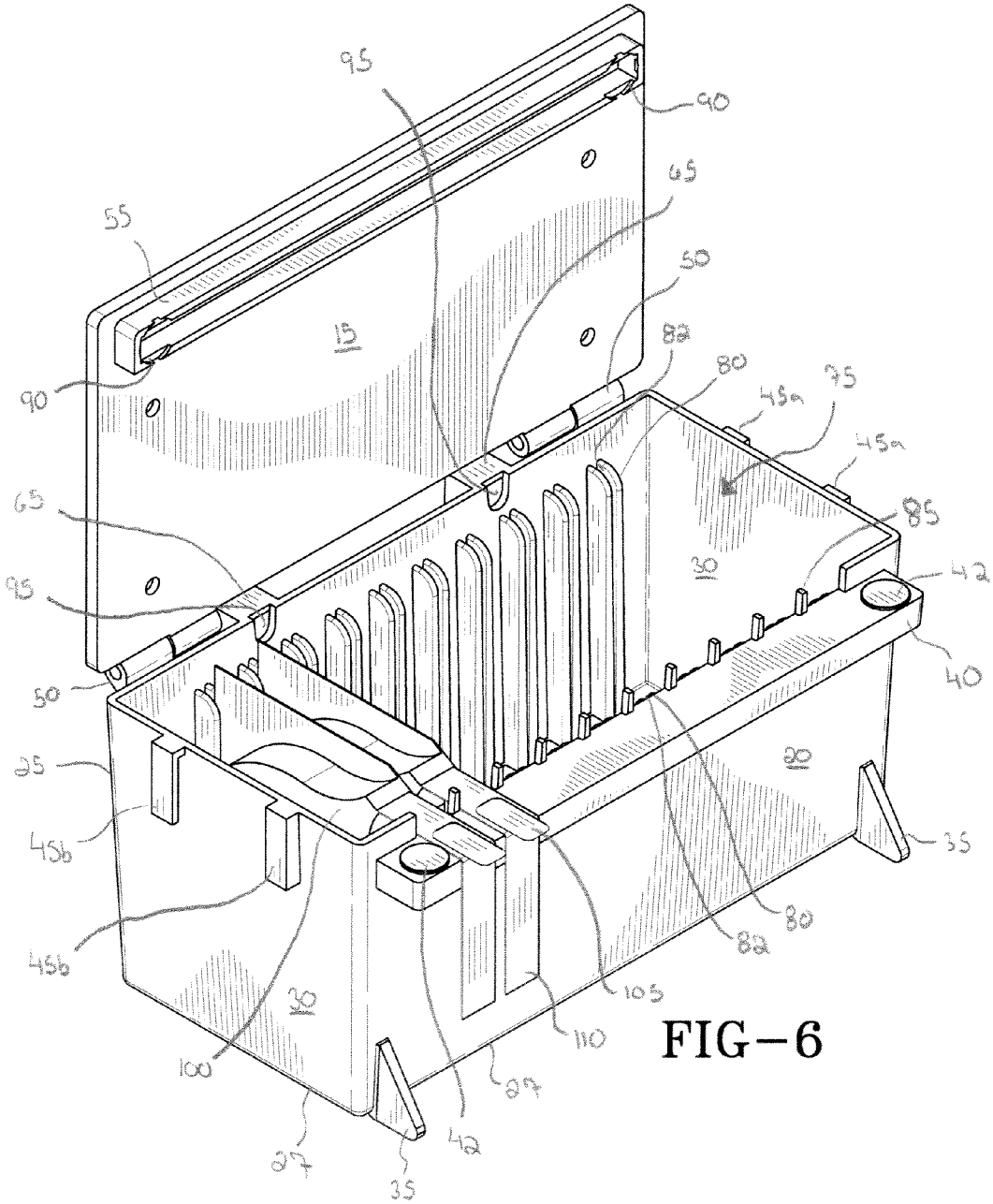
FIG. 6 is a top perspective view of an exemplary embodiment of a label dispenser having its lid open.
Figure 7:
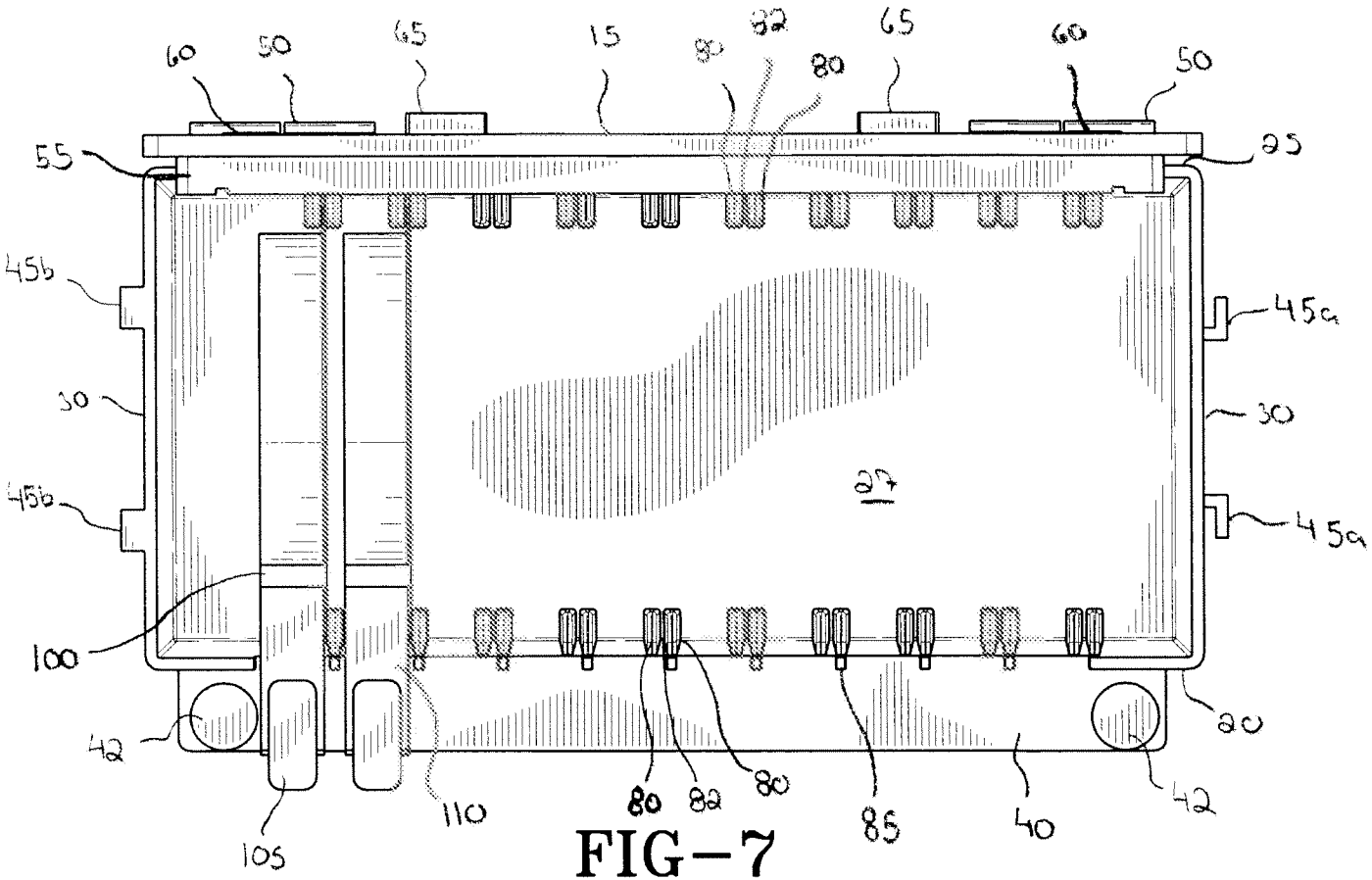
FIG. 7 is a top view of the exemplary label dispenser having its lid open illustrating the placement of label packaging therein.
Figure 8:
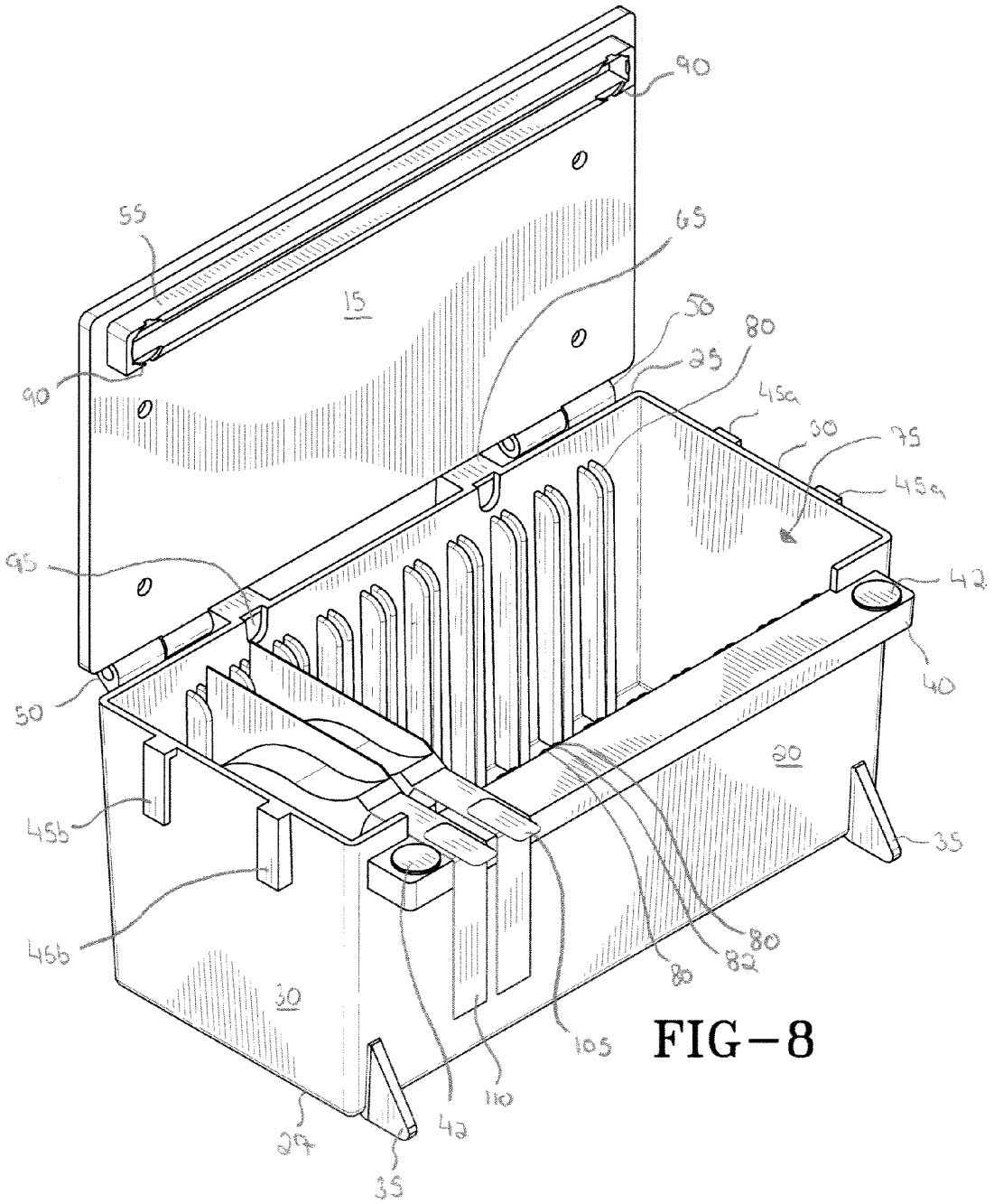
FIG. 8 is a top perspective view of an exemplary embodiment of a label dispenser having its lid open.

Directing attention to the drawings and particularly to FIG. 1, a perspective view is provided for an embodiment of a label dispenser that may be used in conjunction with a label pack 100 (shown in FIGS. 6-8). The dispenser 5 allows the labels 105 to be removed from the liner 110 as they are pulled from the dispenser 5. As illustrated, the exemplary dispenser 5 is primarily constructed from two separate pieces, the first of which is a body 10 and the second which is a lid 15. As shown in FIG. 1, the lid 15 is in the closed configuration. It should be understood that the body 10 and lid 15 may be made from a variety of different materials that are capable of being cleaned and have sufficient strength to withstand the forces associated with dispensing labels; such materials include polystyrene and acrylic.

As shown in FIG. 1, the body 10 has a general rectangular shape. It should also be understood that the body's 10 shape may be generally trapezoidal. In any event the body 10 includes four sides and a bottom. Specifically, the body 10 includes intersecting sides forming a perimeter having a front side 20, back side 25 and end walls 30. A bottom side 27 (shown in detail in FIG. 2) is arranged to intersect with each of the front and back sides 20, 25 and the end walls 30 defining a hollow interior 75 (shown in FIGS. 5-8) for at least one label pack 100.

Optional legs 35 may extend outward from the lower portion of the front side 20. The optional legs 35 may provide support for the dispenser 5. The optional legs 35 may be adhered to the front side 20, mechanically interlocked or molded thereon. Although shown having a triangular shape, the legs 35 may have any shape sufficient to provide support to and stabilize the dispenser 5.

The upper portion of the front side 20 opposite the placement of legs 35 has a flange 40 extending outwardly therefrom. The labels 105 and liners 110 are passed over the flange 40 from the interior 75 of the body 10. The flange 40 may be the entire length of the front side 20 or only a portion of the length of the front side 20 as illustrated in FIG. 1. The flange 40 will be described in more detail with respect to FIG. 2.

Each end wall 30 has at least one connector 45 residing on and extending therefrom. The connectors 45 allow multiple dispensers 5 to be linked together. Although shown as extending from the top portion of the end wall 30, it should be understood that the connector 45 may be located at any position on the end walls 30. More detail with respect to the connectors 45 will be provided herein.

The lid 15 has a generally rectangular shape and is connected to the body 10 by way of at least one hinge 50. One of ordinary skill should appreciate that a variety of hinges types and number of hinges may be used in conjunction with the invention described herein. The hinges 50 are affixed to the lid 15 and the back side 25 of the body allowing the lid 15 to open revealing the hollow interior 75. This allows for easy insertion and removal of the label packs 100. The dimensions of the lid 15 are such that it extends beyond the front side 20 of the body 10 and terminates slightly past the plane formed by the flange 40. This configuration allows a user to easily manipulate the lid 15. A generally rectangular support member 55 extends from the underside of the lid 15 toward the flange 40. The support member 55 is generally coplanar with the flange 40. Both the support member 55 and the flange 40 are arranged to allow the labels 105 and liners 110 to pass therebetween.

The lid 15 also has protrusions 60 extending therefrom. The protrusions 60 are provided to allow multiple dispensers 5 to be arranged in a stacked configuration. The protrusions 60 are designed to complementarily engage receiving members 70 (shown in FIG. 2) and allow the multiple dispensers 5 to be securely stacked atop one another. Although shown as circular, the protrusions 60 may have other shapes, such as rectangular, triangular, or other geometric shapes. However, it should be understood that whatever shape employed for the protrusions 60 on the lid, the receiving members 70 must also have a complementary shape.

Attachment members 65 are also provided on the back side 25 of the dispenser 5. The attachment members 65 extend from the back side 25 past the hinges 50. The attachment members 65 allow the dispenser 5 to be fixed to a surface, such as a wall. The attachment members 65 ensure that the surface the dispenser 5 is attached to does not interfere with operation of the lid 15 and hinges 50.

Figure 2:
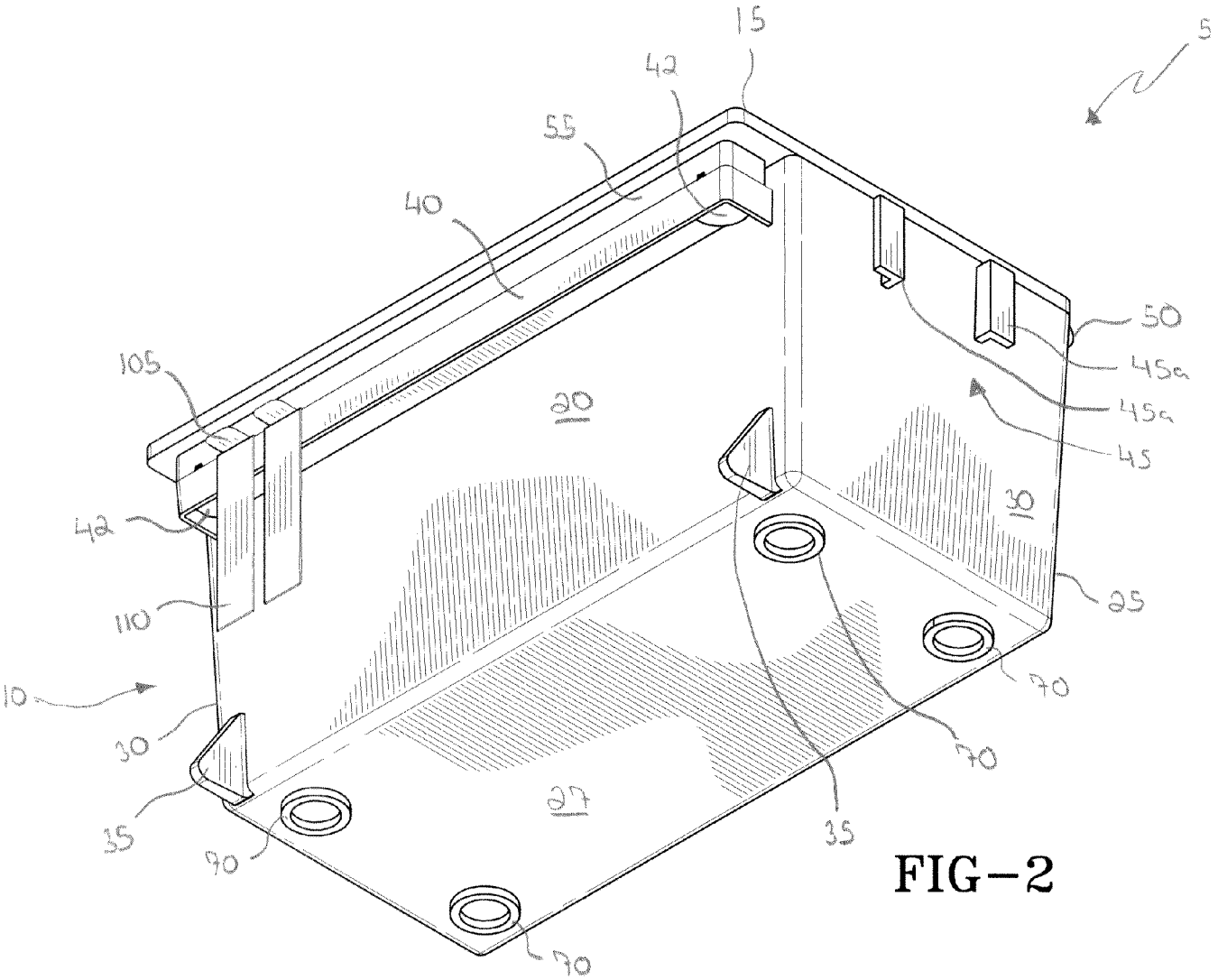
FIG. 2 is a bottom perspective view of the exemplary label dispenser.

FIG. 2 illustrates a bottom perspective view of the dispenser 5 shown in FIG. 1. The bottom perspective view reveals elements of the dispenser 5 not visible in the perspective view of FIG. 1, including the receiving members 70. As shown, the receiving members 70 extend from the bottom 25 of the body 10. As discussed earlier, the receiving members 70 are configured to complementarily engage the protrusions 60. To stack multiple dispensers 5, one dispenser 5 is positioned so that the protrusions 60 on the lid 15 of the bottom dispenser 5 are aligned with the receiving members 70 on the bottom 25 of the top dispenser 5; the protrusions 60 nesting in the receiving members 70.

FIG. 2 also shows the underside of the flange 40. As illustrated, the edges of the flange 40 are turned down increasing the rigidity of the flange 40. In addition, this downturn creates a channel into which magnets 42 may be placed. The magnets 42 may be positioned at any position within the channel in the flange 40. However, preferably the magnets 42 are placed near the terminal ends of the flange 40. The magnets 42 are aligned with magnets or other ferromagnetic material in the support member 55 extending from the lid 15, in order to keep the lid 15 in a closed position.

FIG. 2 also illustrates connectors 45 extending from the end wall 30. In a comparison of FIG. 1 and FIG. 2, it can be seen that male connectors 45*a* extend from one end wall 30 (FIG. 2) and female connectors 45*b* extend from the opposite end wall 30 (FIG. 1). It should be noted that the conventional assignment designation of female and male for mating connectors has been used herein, where the "female" connector is generally a receptacle that receives and holds the "male" connector. In this embodiment, the male connectors 45*a* have an L-shape while the female connectors 45*b* have a complementary L-shape allowing the male connectors 45*a* to mate with the female connectors 45*b*. To link multiple dispensers 5 end-to-end, the male connector 45*a* is simply slid into the female connector 45*b* on another dispenser 5. As stated above, it should be understood that various types of connectors 45 may be used to link dispensers 5.

Figure 3:
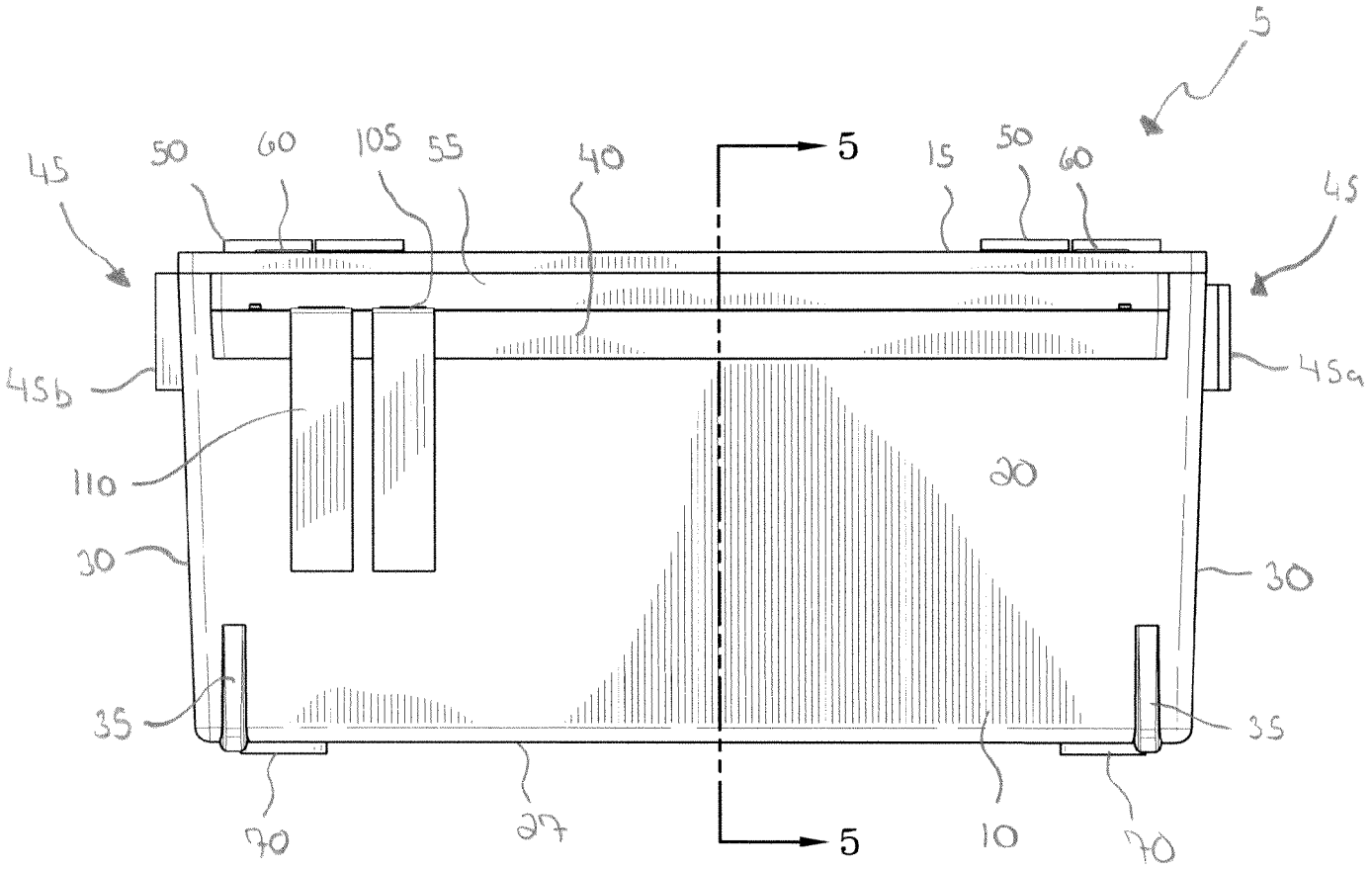
FIG. 3 is a front view of the exemplary label dispenser having its lid closed.

FIG. 3 is a front view of the dispenser 5 depicted in FIGS. 1 and 2. As shown, the support member 55 and flange 40 are coextensive with each other. However, it should be noted that in other embodiments of the dispenser 5, that the support member 55 and flange 40 may not be coextensive. However, in each embodiment, the magnets 42 located in the flange 40 should be aligned with the magnets or ferromagnetic material in the support member 55. A bisecting line 5-5 is also indicated in FIG. 3, the cross-sectional view of which is illustrated in FIG. 5.

Figure 4:
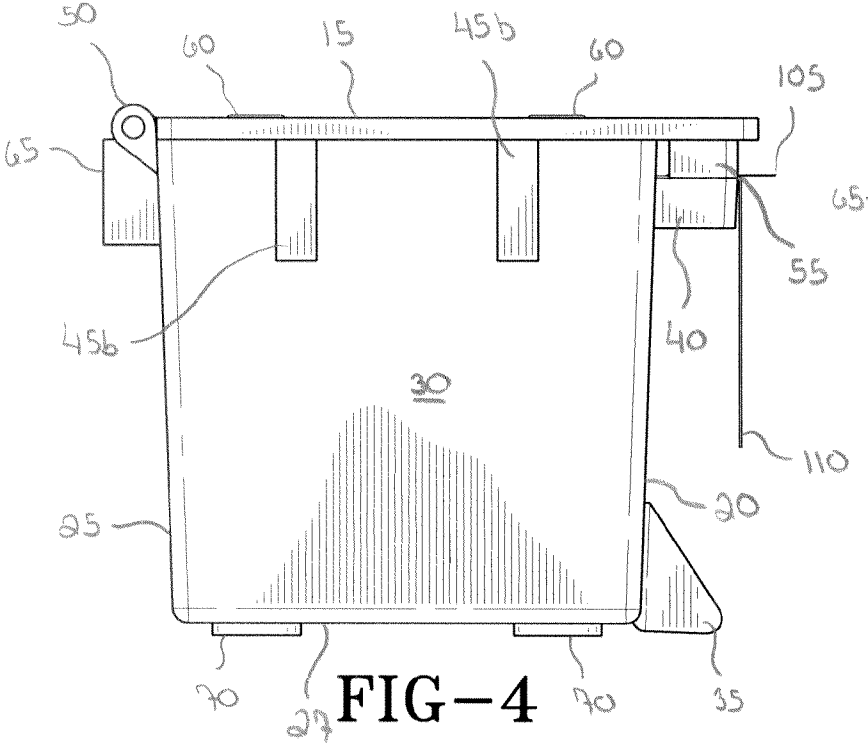
FIG. 4 is a side view of the exemplary label dispenser in FIG. 1.

FIG. 4 is a side view of the dispenser 5 depicted in FIG. 1. As illustrated in FIG. 4, the labels 105 and liner 110 passes between the support member 55 and the flange 40. To automatically remove the label 105 from the liner 110, the liner 110 is pulled downward from the flange 40. Although the liner 110 is shown at a 90 degree angle relative to the flange 40, such a steep angle is not required. Nearly any downward angle from the flange 40 would be sufficient to force the liner 110 away from the label 105. In order to accommodate this downward angle, the flange 40 extends from the front side 20. This allows a user to grasp the liner 110 and pull downward without interference from the front side 20 of the body 10.

Figure 5:
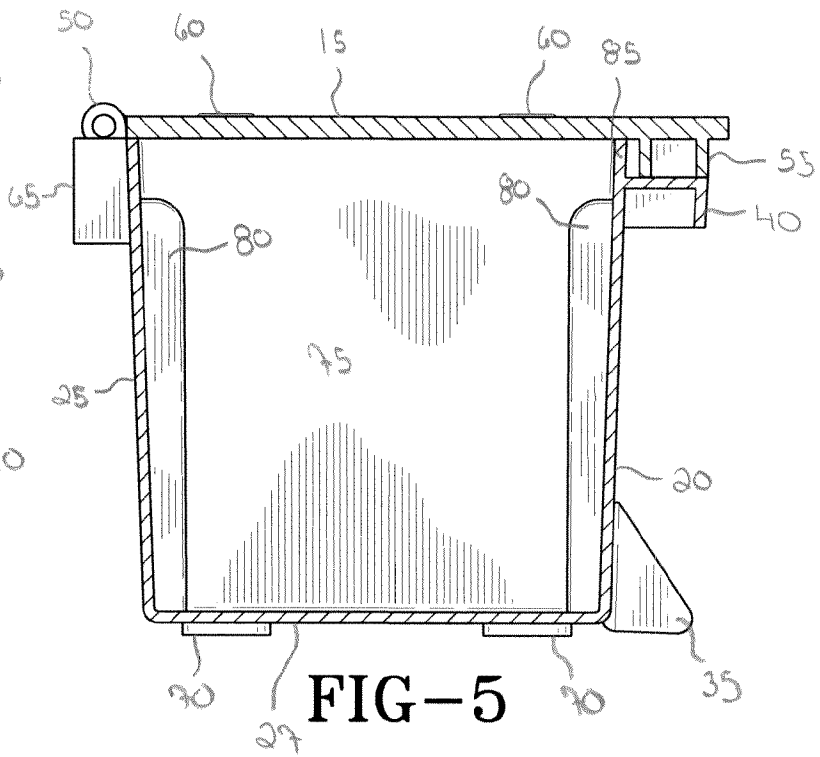
FIG. 5 is a cross-sectional view of the exemplary label dispenser at line 5-5.

Directing attention now to the cross-sectional view of dispenser 5 illustrated in FIG. 5. FIG. 5 shows the hollow interior 75 defined by the body 10. The hollow interior 75 receives and holds the label packs 100. Guides 80 are shown residing on the inside of the hollow interior 75 and extending from the front and back sides 20, 25. The guides 80 are discussed in more detail with respect to FIG. 6. Tabs 85 are also shown in FIG. 5. The tabs 85 extend upward from the front side 20 and terminate at the lid 15 when in the closed position. The tabs 85 will be more fully discussed in relation to FIG. 6.

As seen in FIGS. 4 and 5, the lid 15 rests upon the body 10, and specifically the back side 25, portions of the front side 20, and the end walls 30, when in the closed position. As described above and illustrated clearly in FIGS. 4 and 5, the lid 15 overhangs the front side 20 and has a support member 55 extending downward therefrom. The support member 55 is aligned with the flange 40 extending from the front side 20. Although shown in close proximity, the support member 55 does not rest against the flange 40. Rather, there is a gap of approximately 0.1016 to about 0.254 mm between the support member 55 and the flange 40. In any event, the gap between the support member 55 and the flange 40 should not be less than the combined thickness of the label 105 and the liner 110. However, it should be noted that the portions of the flange 40 containing the magnets 42 may be closer to the support member 55 due to the attractive forces of the magnet 42.

FIG. 6 illustrates the dispenser 5 having the lid 15 in an open arrangement showing the hollow interior 75 of the dispenser 5. As shown, guides 80 are arranged in pairs along both the front and back sides 20, 25 of the body 10. The guides 80 are in a parallel spaced apart arrangement creating a slot 82 therebetween. The guides 80 on both the front and back sides 20, 25 are aligned with one another so that the packaging of the label packs 100 can be slid into the slots 82 and held vertically therein. The labels 105 and the liner 110 are then threaded between the tabs 85. The tabs 85 act as guides for the labels 105 and liner 110 to prevent lateral movement during use. As shown the tabs 85 extend from the flange 40. The tabs 85 may be scored at their base where they are joined with the flange 40. This scoring allows the tabs 85 to be broken off if desired to accommodate wider labels 105 and liners 110.

With the lid 15 in the open configuration, additional features of the supporting member 55 are visible. As can be seen in FIG. 6, the supporting member 55 has a rounded rectangular shape. At either end of the supporting member 55 are apertures 90. The apertures 90 are adapted to receive and hold a magnet or other ferromagnetic material. Although shown located on the ends of the supporting member 55 the apertures 90 may be at any location along the supporting member 55 to line up with the magnets 42 in the flange 40.

Along the top portion of the back side 25 in the hollow interior 75 of the body 10, there are access ports 95. The access ports 95 allow for access to a fastener positioned in the attachment members 65. In this way the fasteners used to fix the dispenser 5 to a surface, such as a wall, will not interfere with the insertion and removal of the label packs 100 in the hollow interior 75 of the body 10.

FIG. 8 illustrates another embodiment of the dispenser 205 without tabs 85. As described above, the tabs 85 may be removed to accommodate various widths of labels 105. It should also be understood that some embodiments of the dispenser 205 may be manufactured without tabs 85. Other than lacking tabs 85, the dispenser 205 in FIG. 8 is identical to the dispenser 5 illustrated in FIGS. 1-7.

Figure 9:
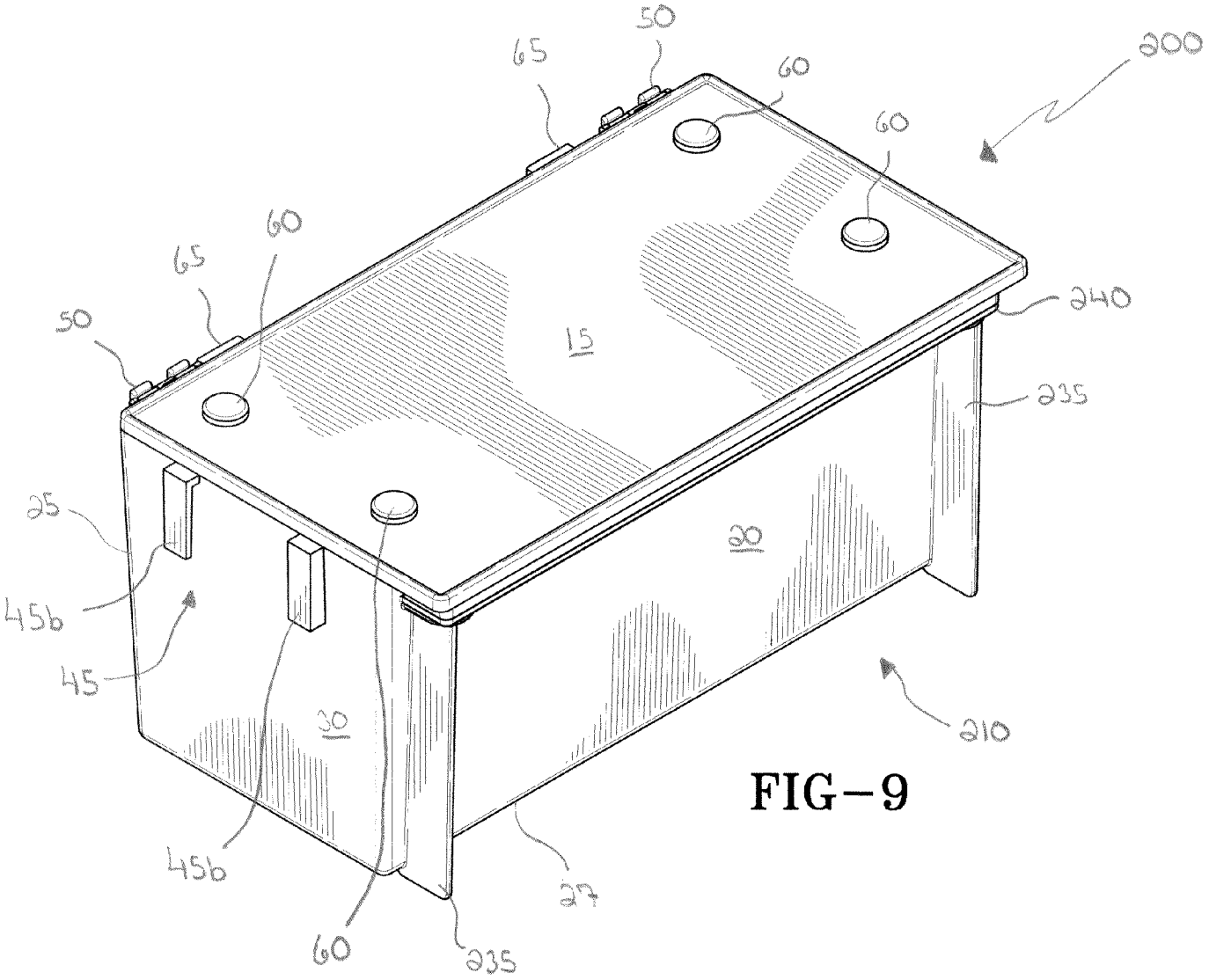
FIG. 9 is a top perspective view of another exemplary embodiment of a label dispenser having its lid in the closed position.
Figure 10:
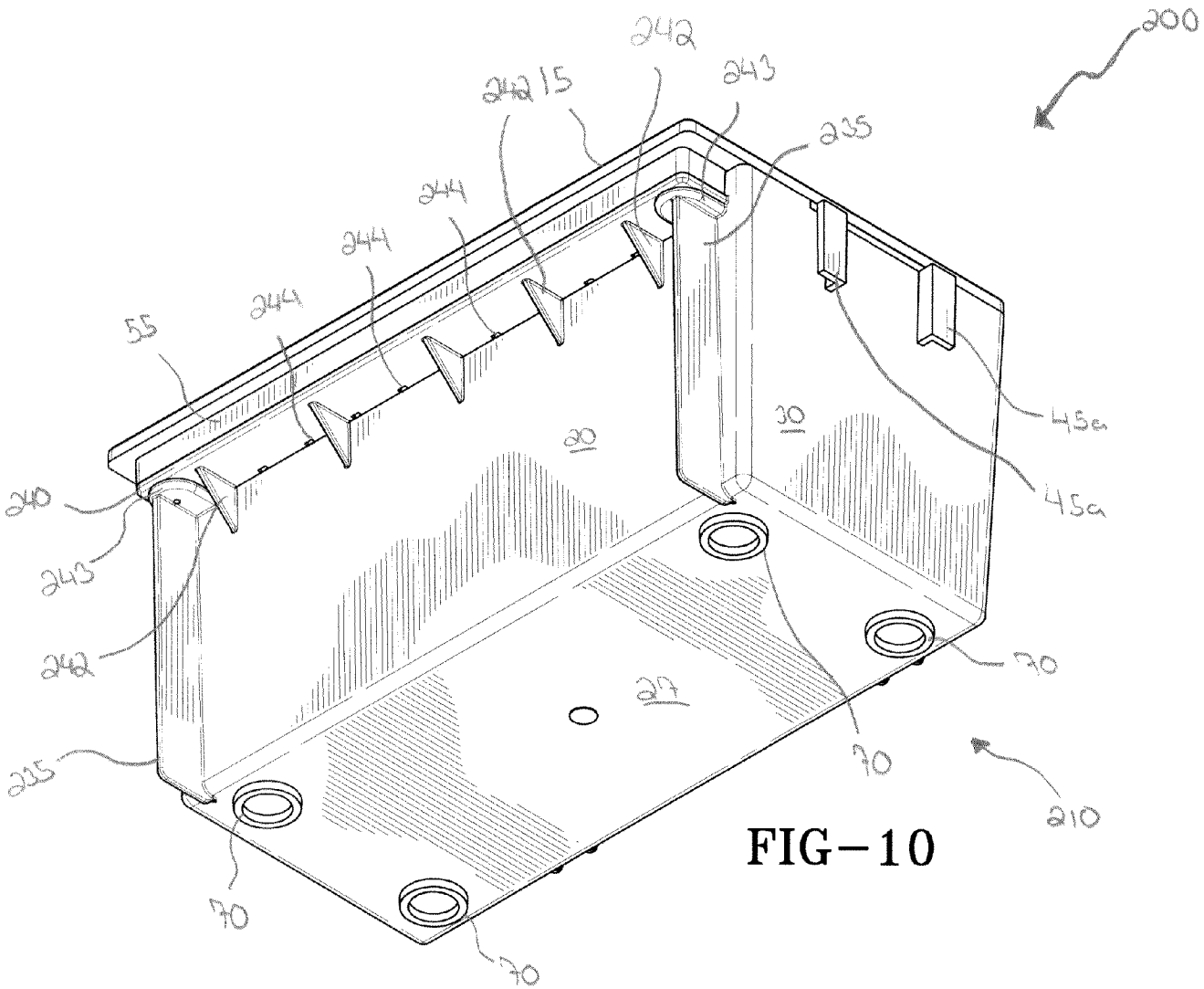
FIG. 10 is a bottom perspective view of the dispenser in FIG. 9.

Directing attention now to FIGS. 9-10, another embodiment of a label dispenser 200 that may be used in conjunction with a label pack 100 is illustrated. The dispenser 200 allows the labels 105 to be removed from the liner 110 as they are pulled from the dispenser 200. This function of dispenser 200 is substantially similar to that of dispenser 5. As with previous embodiments, the exemplary dispenser 200 is primarily constructed from a body 210 and a lid 15. Like other embodiments, it should be understood that the body 210 and the lid 15 may be made from a variety of different materials that are capable of being cleaned and have sufficient strength to withstand the forces associated with dispensing labels. Such materials include polystyrene and acrylic.

The body 210 may have a generally rectangular or trapezoidal shape. In any event, the body 210 includes four sides and a bottom. Specifically, the body 210 includes intersecting sides forming a perimeter having a front side 20, a back side 25 and end walls 30. The bottom side 27 (shown in detail in FIG. 10) is arranged to intersect with each of the front and back sides 20, 25 and the end walls 30 defining a hollow interior 75 (shown in FIGS. 13-14) to accommodate at least one label pack 100.

Rather than optional legs 35, this embodiment of the dispenser 200 has a pair of support braces 235 extending outward from the front side 20. The support braces 235 provide support against tipping and add strength to the front side 20 of the dispenser 200. The support braces 235 begin at the bottom of the front side 20 and extend upward till terminating at the ledge 240.

Attachment members 65 are also provided on the back side 25 of the dispenser 200 and extend outwardly from the back side 25 past the hinges 50. The extension of the attachment members 65 beyond the hinges 50 allows the dispenser 200 to be fixed to a surface such as a wall without interfering with the lid 15 or hinges 50. The attachment members 65 will be discussed in more detail with respect to FIG. 15.

As illustrated in FIG. 10, the upper portion of the front side 220 has a ledge 240 extending outwardly therefrom. The labels 105 and liners 110 are passed over the ledge 240 from the interior of the body 210. The ledge 240 may span the entire length of the front side 20 or only a portion thereof as illustrated in FIG. 9. Supports 242 are provided under the ledge 240 to provide support for the ledge 240 during use. As illustrated, the supports 240 have a triangular shape, but those of skill in the art will appreciate that other shapes may be used. As shown, the end walls 30 utilize the same connector 45 as used with dispenser 5. The connectors 45 allow the dispensers 200 to be linked together.

The lid 15 has a generally rectangular shape and is connected to the body 210 by way of at least one hinge 50. As mentioned with respect to the other embodiments, it should be appreciated that a variety of hinge styles may be used. The hinges 50 are affixed to the lid 15 and the back side 25 of the body 210 allowing the lid 15 to open revealing the hollow interior 75 for insertion and removal of label packs 100. The dimensions of the lid 15 are such that it extends beyond the front side 20 and terminates slightly past the plane of the ledge 240 for easy manipulation, as shown in FIG. 10. A generally rectangular support member 55 extends from the underside of the lid 15 toward the ledge 240. The support member 55 is generally coplanar with the ledge 240. Both the support member 55 and the ledge 240 are arranged to allow labels 105 and liners 110 to pass therebetween.

As with the previous dispenser 5 embodiment, this embodiment has protrusions 60 extending upward therefrom. These protrusions 60 residing on the lid 15 are designed for complementary engagement with receiving members 70 in the bottom side 27. This engagement allows for multiple dispensers 200 to be stacked atop one another.

FIG. 10 illustrates the underside of ledge 240. As shown, the portion of the ledge 240 that intersects with the front side 20 has a number of indents 244 therein. These indents 244 correspond to the tabs 85 (shown in FIG. 14). These indents 244 allow the tabs 85 to be easily broken away from the ledge 240. After a tab 85 is broken off the ledge 240 the indent 244 may pass completely through the ledge 240. The underside view of the ledge 240 also makes visible the underside of the receptacles 243. The receptacles 243 are depressions in the ledge 240 that are adapted to receive either a magnet or ferromagnetic material. As shown, the receptacles 243 are placed at either end of the ledge 240.

FIG. 10 better illustrates the connectors 45 extending from the end wall 230. The same type of male and female connectors 45*a*, 45*b* are used in both embodiments of the dispenser 5, 200, and are used to link multiple dispensers 5, 200 together.

Figure 11:
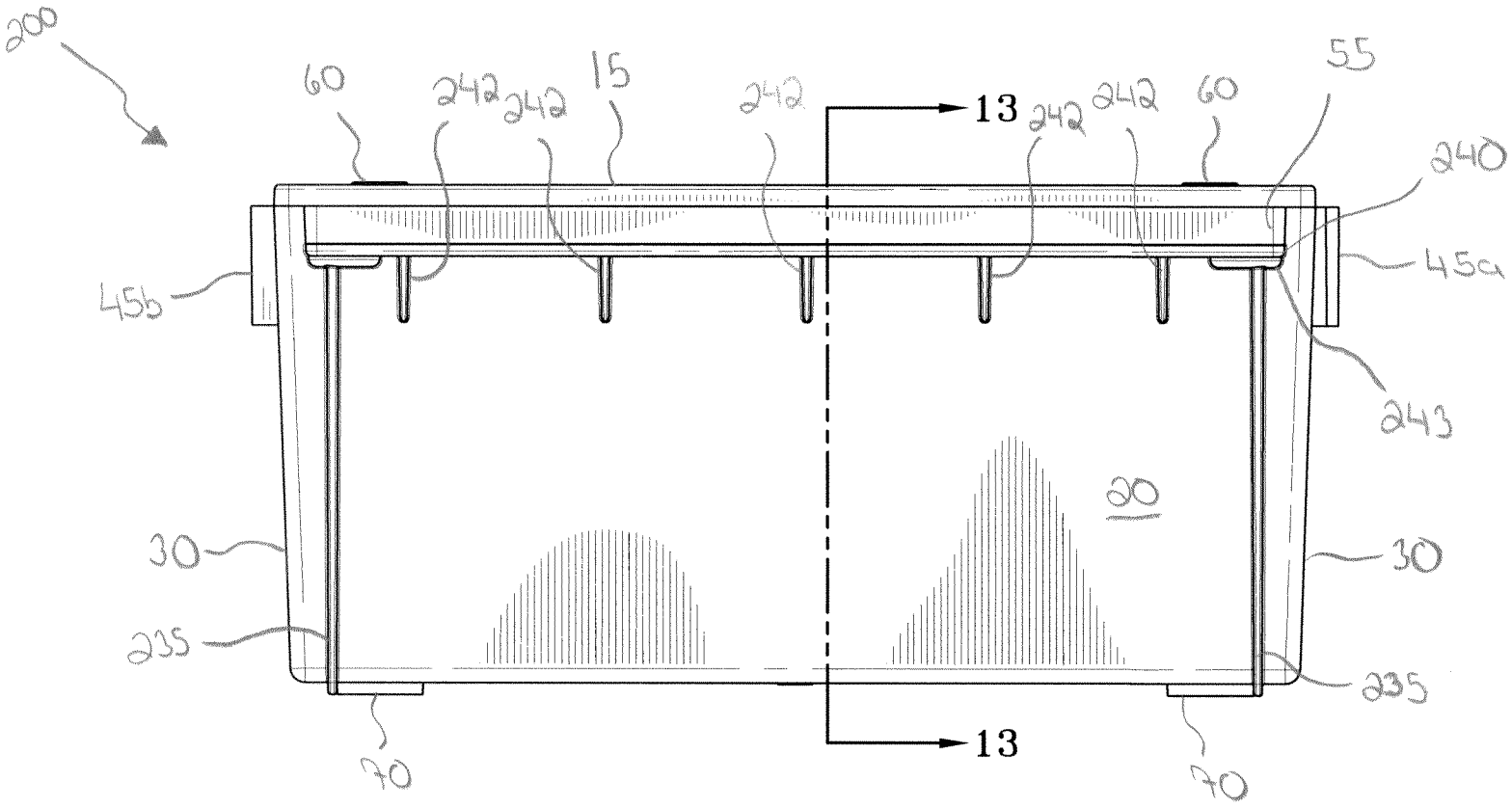
FIG. 11 is a front view of the dispenser in FIG. 9 having its lid in the closed position.

FIG. 11 is a front view of the dispenser 200 depicted in FIGS. 9 and 10. As shown, the support member 55 and the ledge 240 are coextensive with each other. However, it should be noted that this coextensive feature is not necessary. As illustrated in FIG. 11, the support braces 235 extend below the bottom surface 27 and are substantially planar with the receiving members 70. The support braces 235 extend substantially parallel up the front side 20; however, it should be understood that the support braces 235 may also be arranged in a non-parallel configuration. A bisecting line 13-13 is also indicated in FIG. 11.

Figure 12:
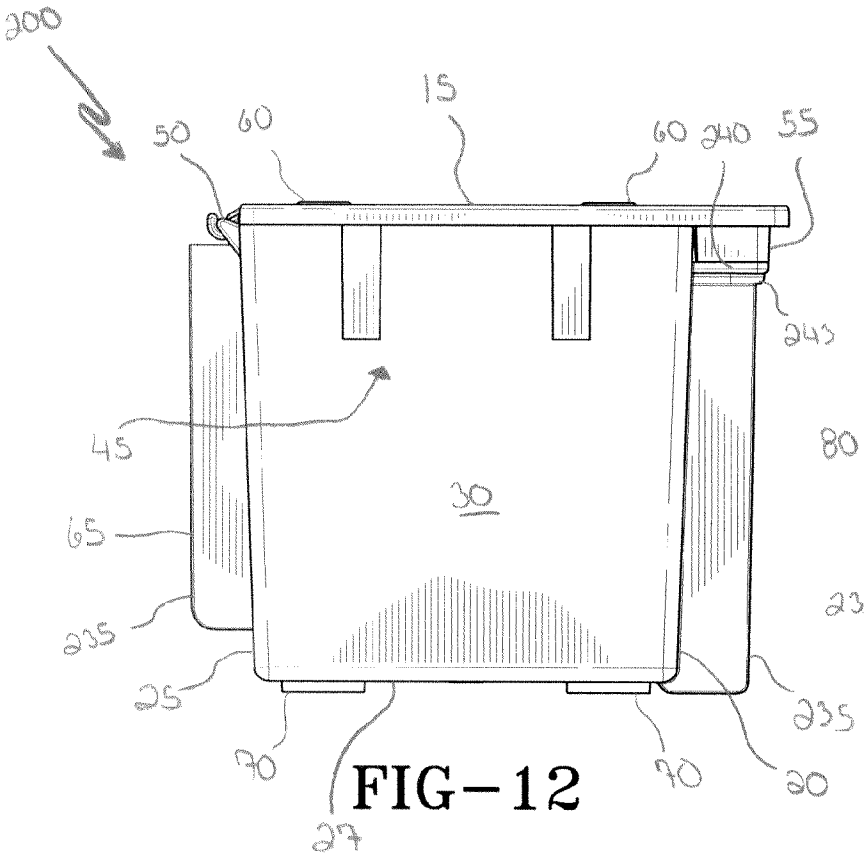
FIG. 12 is a side view of the dispenser in FIG. 9.

FIG. 12 is a side view of the dispenser 200 depicted in FIG. 9. As with the dispenser 5, dispenser 200 provides passage of the labels 105 and liner 110 between the support member 55 and the ledge 240. Accordingly, the label 105 is removed from the liner 110 in substantially the same manner; by pulling the liner 110 downward when using the dispenser 200. To accommodate this downward angle, the ledge 240 extends from the front side 20 sufficient to prevent interference from the front side 20 of the body 210.

Figure 13:
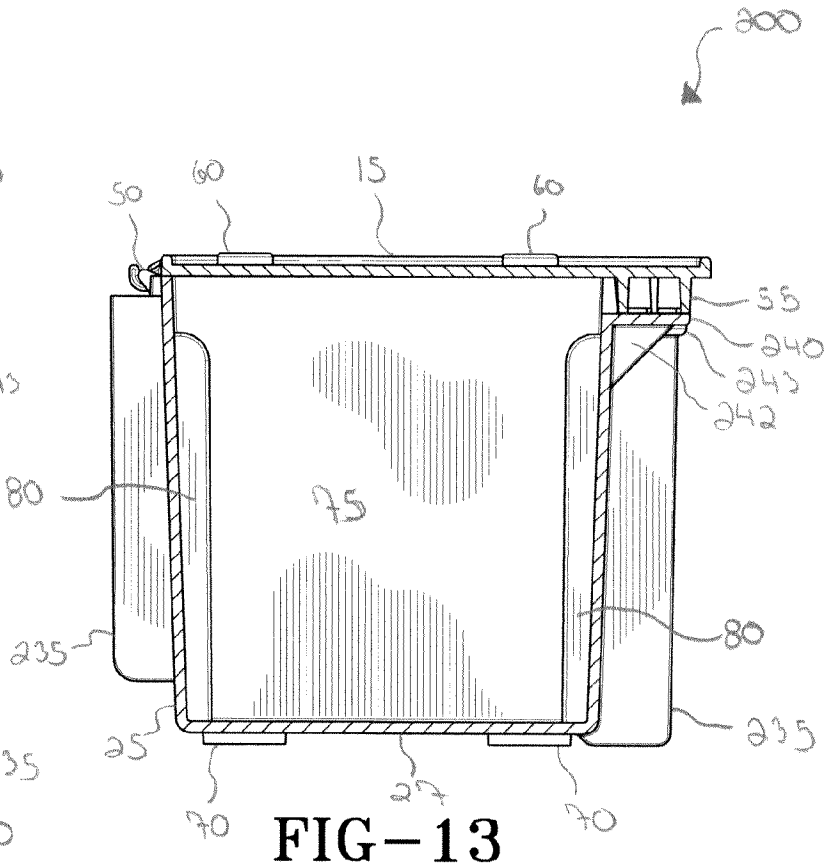
FIG. 13 is a cross sectional view of the exemplary label dispenser in FIG. 9 at line 13-13.

Directing attention now to cross-sectional view of dispenser 200 shown in FIG. 13, the hollow interior 75 of the body 210 is illustrated. Guides 80 are shown residing on the inside of the hollow interior 75 and extending from the front and back sides 20, 25. The guides 80 are discussed in more detail with respect to FIG. 14.

As seen in FIGS. 12 and 13, the lid 15 rests upon the back and front sides 25, 20 and the end walls 30 of the body 210 when in the closed position. The lid 215 overhangs the front side 20 and has a support member 55 extending downward therefrom aligned with the ledge 240. As with the first embodiment of the dispenser 5, this embodiment of the dispenser 200 provides for a gap of approximately 0.1016 to about 0.254 mm between the support member 55 and the ledge 240. In any event, the gap between the support member 55 and the ledge 240 should not be less than the combined thickness of the label 105 and the liner 110. However, it should be noted that the portions of the flange 240 containing the magnets 42 may be closer to the support member 55 due to the attractive forces.

Figure 14:
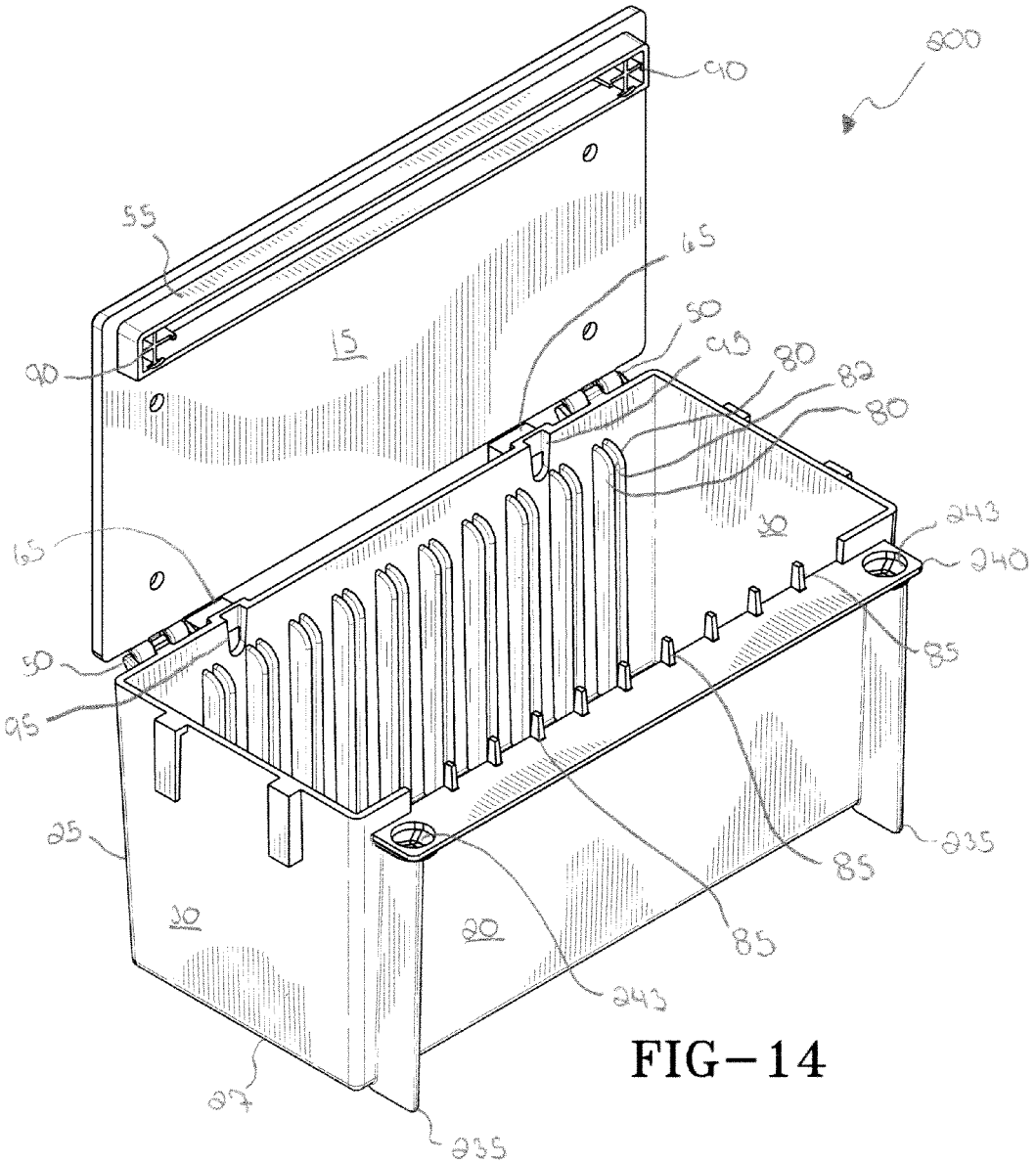
FIG. 14 is a top perspective view of the exemplary label dispenser in FIG. 9 having its lid in the open position.

FIG. 14 illustrates the dispenser 200 having the lid 15 in an open arrangement allowing visibility of the hollow interior 75 of the dispenser 200. As shown, guides 80 are arranged in pairs along both the front and back sides 20, 25 of the body 210. The guides 80 are in a parallel spaced apart arrangement creating a slot 82 therebetween. The guides 80 on both the front and back sides 20, 25 are aligned with one another so that the packaging of the label packs 100 can be slid into the slots 82 and held vertically therein. The labels 105 and the liner 110 are then threaded between the tabs 85. The tabs 85 act as guides for the labels 105 and liner 110 to prevent lateral movement during use. As shown, the tabs 85 extend from the ledge 240. Although this dispenser 200 utilizes the indents 244, the tabs 85 may also be scored to allow for easier removal.

As illustrated in FIG. 14, the underside of the support member 55 is visible. As can be seen the support member 55 has a rounded rectangular shape having apertures 90 adapted to receive and hold a magnet 42 or other ferromagnetic material. Although shown located on the ends of the supporting member 55, the apertures 90 may be at any location along the supporting member 55 to line up with the magnets 42 in the ledge 240. Likewise, the receptacles 243 in the ledge 240 are visible in FIG. 14. The receptacles 243 are arranged at opposing ends of the ledge 240 and are adapted to receive a magnet 42 or other ferromagnetic material. Although shown at opposing ends of the ledge 240, it should be understood that the receptacles 243 could be moved along the ledge 240 to align with the apertures 90 in the support member 55.

Along the top portion of the back side 25 in the hollow interior 75 of the body 210, there are access ports 95. The access ports 95 allow for access to a fastener positioned in the attachment members 65. In this way the fasteners used to fix the dispenser 200 to a surface, such as a wall, will not interfere with the insertion and removal of the label packs 100 in the hollow interior 75 of the body 210.

Figure 15:
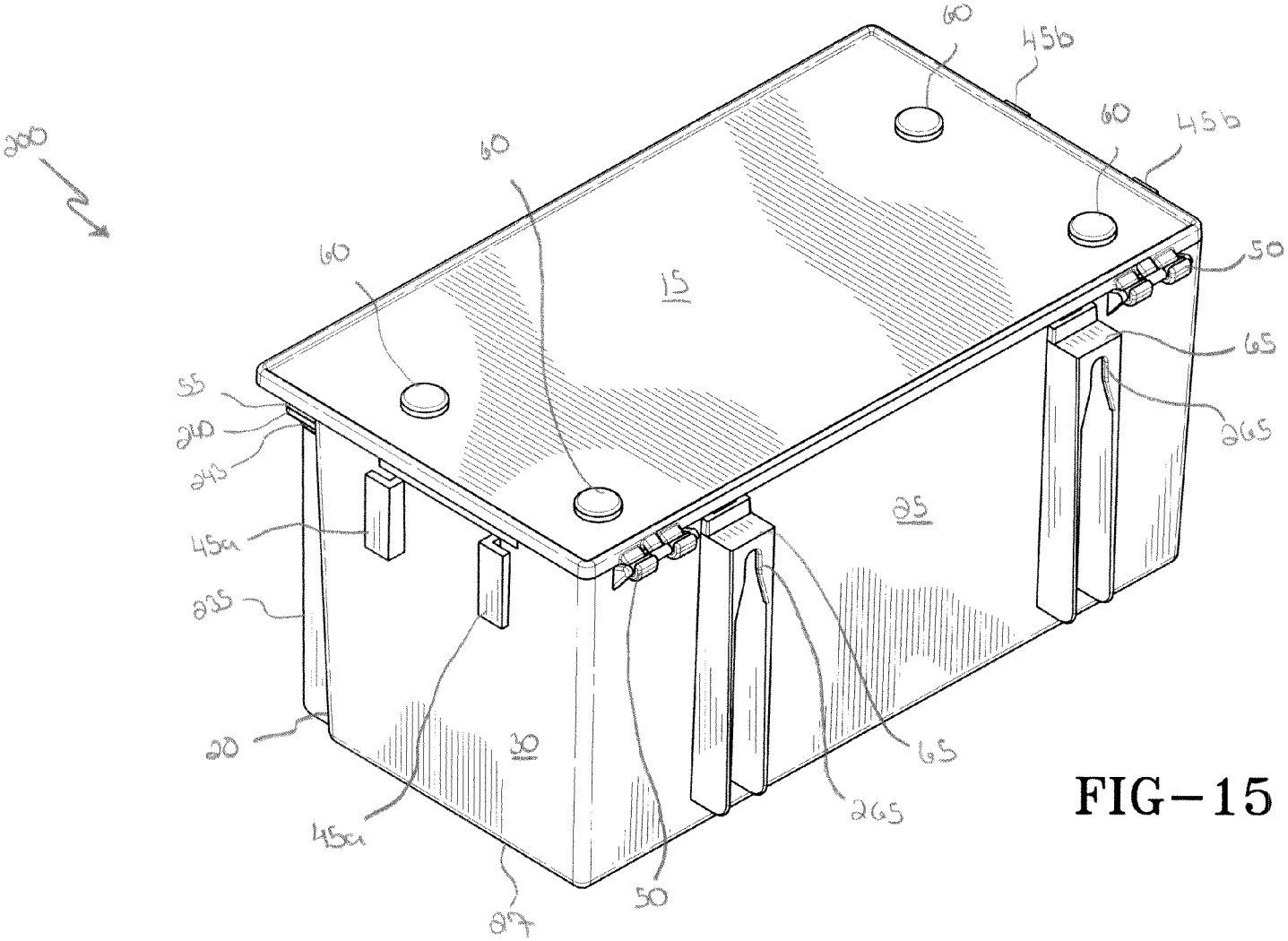
FIG. 15 is a rear perspective view of the exemplary dispenser in FIG. 9.

FIG. 15 is a rear perspective view of the dispenser 200, illustrating the attachment members 65. As shown, the attachment member 65 is recessed from the top portion of the back side 25. This recess prevents the attachment member 65 from interfering with the lid 215 when it is in the open position. Furthermore, the attachment members 65 extend beyond the hinges 50 to prevent interferences when the dispenser 200 is used against a wall. A notch 265 is provided in each attachment member 65 to receive a mechanical fastener. The mechanical fastener rests within the notches 265 to support the weight of the dispenser 200. Although these features of the attachment member 65 are shown in relationship to the dispenser 200, it should be understood that they are also present on dispenser 5.

While the embodiments disclosed described the best modes known to the inventor at the time of filing, the scope of the invention is not to be limited to only the embodiments disclosed herein.

What is claimed is:

1. A label dispenser, comprising:

a body having a hollow interior, said body having a front side, a back side, end walls and a bottom;

a lid connected to the back side of said body by at least one hinge;

a ledge extending outwardly from said front side, said ledge having at least one receptacle therein;

supports extending from the front side and intersecting with said ledge;

a pair of braces extending outwardly from said front side, said braces terminating at said ledge;

a support member extending from said lid having apertures therein for receiving a magnet or ferromagnetic material, said support member aligned with said ledge;

at least one connector located on each end wall; and guides extending inward into the hollow interior space for holding a label pack.

2. The label dispenser of claim 1, further comprising at least one attachment member extending outwardly from said back side.

3. The label dispenser of claim 2, wherein said attachment member is recessed.

4. The label dispenser of claim 1, further comprising:

at least one protrusion extending outwardly from said lid;

at least one receiving member extending outwardly from said bottom, wherein said receiving member on a first dispenser is adapted to receive said protrusion on a second dispenser for stacking.

5. The label dispenser of claim 1, wherein said lid rests atop said back side and end walls when in a closed position.

6. The label dispenser of claim 1, further comprising a gap of about 0.1016 to about 0.254 mm between said ledge and said support member when said lid is in a closed position.

7. The label dispenser of claim 1, further comprising tabs extending upward from said ledge.

8. The label dispenser of claim 7, wherein said tabs are adapted for removal.

9. The label dispenser of claim 2, further comprising an access port passing through said back side and aligned with each of said at least one attachment member.

10. A label dispenser, comprising:

a body having a hollow interior;

a lid attached to said body by way of at least one hinge, said lid having a support member extending therefrom;

a ledge extending from a top portion of said body;

at least one magnet disposed in each of said ledge and said support member;

a gap of about 0.1016 to about 0.254 mm between said ledge and said support member when said lid is in a closed position; and a plurality of guide pairs arranged in the hollow interior of the body for holding label packs, wherein the contents of the label packs is threaded over the ledge and rests between said ledge and said support member when said lid is in the closed position.

11. The label dispenser of claim 10, further comprising a means for linking multiple dispensers disposed on said body.

12. The label dispenser of claim 10, further comprising:

at least one protrusion extending outwardly from said lid;

at least one receiving member extending outwardly from a bottom of said body, wherein said receiving member on a first dispenser is adapted to receive said protrusion on a second dispenser for stacking.

13. The label dispenser of claim 10, further comprising a plurality of tabs extending vertically from said ledge, said tabs adapted for removal.

14. The label dispenser of claim 10, further comprising at least one brace disposed on the body and extending downward from said ledge.

15. The label dispenser of claim 10, further comprising at least one attachment member arranged on the body opposite said ledge, said attachment member recess from a top edge of said body.

16. The label dispenser of claim 10, further comprising triangular supports positioned beneath said ledge.

17. The label dispenser of claim 13, wherein said tabs are scored.

18. A label dispenser, comprising:

a body formed by a front side, a back side, a bottom and opposing end walls, said body having a hollow interior;

a lid connected to said body at said back side by way of at least one hinge;

a ledge extending outwardly from a top portion of said front side;

a pair of receptacle in said ledge in a spaced apart arrangement, said receptacles adapted to receive a magnet or other ferromagnetic material;

a plurality of triangular supports extending from said front side and intersecting with said ledge;

a pair of braces running vertically along said front side, said braces terminating at said receptacles;

a support member extending downward from said lid, said support member arranged such that when said lid is in a closed position said support member is coextensive with said ledge;

a pair of apertures in said support member, said apertures are arranged to align with said receptacles in said ledge and are adapted to receive a magnet or other ferromagnetic material;

at least one connector located on each end wall;

guides extending inward from both said front side and said back side, said guides arranged in pairs to hold a label pack therebetween;

at least one attachment member disposed on said back side, said attachment member recessed from a top edge of said back side;

a plurality of tabs extending upwardly from said ledge, said tabs adapted for removal to accommodate varying widths of labels; and a gap of about 0.1016 to about 0.254 mm between said ledge and said support member when said lid is in the closed position, wherein said label and liner from said label pack are threaded in between said ledge and said support member and a downward force is applied to said liner to automatically remove said label.

19. The dispenser of claim 18, further comprising:

at least one protrusion extending outwardly from said lid;

at least one receiving member extending outwardly from said bottom, wherein said receiving member on a first dispenser is adapted to receive said protrusion on a second dispenser for stacking.

20. The dispenser of claim 18, further comprising at least one access port passing through said back side and aligned with each of said at least one attachment member.

* * * * *